US009351618B2

(12) United States Patent
Van Der Kooi et al.

(10) Patent No.: US 9,351,618 B2
(45) Date of Patent: May 31, 2016

(54) NOZZLE ARRANGEMENT FOR A CLEANING DEVICE

(71) Applicant: KONINKLIJKE PHILIPS N.V., Eindhoven (NL)

(72) Inventors: Johannes Tseard Van Der Kooi, Eindhoven (NL); Matthijs Hendrikus Lubbers, Eindhoven (NL); Ralph Pierre Krebbers, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/430,698

(22) PCT Filed: Dec. 13, 2013

(86) PCT No.: PCT/EP2013/076490

§ 371 (c)(1),
(2) Date: Mar. 24, 2015

(87) PCT Pub. No.: WO2014/095604

PCT Pub. Date: Jun. 26, 2014

(65) Prior Publication Data

US 2015/0289735 A1 Oct. 15, 2015

(30) Foreign Application Priority Data

Dec. 18, 2012 (EP) ..... 12197641

(51) Int. Cl.
*A47L 9/04* (2006.01)
*A47L 9/02* (2006.01)

(52) U.S. Cl.
CPC ..... *A47L 9/0477* (2013.01); *A47L 9/02* (2013.01); *A47L 9/04* (2013.01)

(58) Field of Classification Search
CPC ..... A47L 9/0477; A47L 9/02; A47L 9/04; A47L 5/30; A47L 5/34
See application file for complete search history.

(56) References Cited

U.S. PATENT DOCUMENTS 1,483,976 A 2/1924 Hoover
2,026,414 A * 12/1935 Burch ..... A47L 11/33 15/48

(Continued)

FOREIGN PATENT DOCUMENTS

EP 0042370 A1 12/1981
JP 02224629 A 9/1990

*Primary Examiner* — Dung Van Nguyen

(57) ABSTRACT

The present invention relates to a nozzle arrangement (10) for a floor cleaning device (100), comprising a nozzle housing (28); a brush (12) rotatable about a brush axis (14), wherein the brush (12) is partially surrounded by the nozzle housing (28) and protrudes from a bottom side (30) of said nozzle housing (28), said brush (12) being provided with brush elements (16) for picking up dirt and/or liquid particles (22, 24) from a surface to be cleaned (20) during the rotation of the brush (12), and a protection assembly (32) for preventing obstacles (40) from getting sucked into the nozzle housing (28) or wrapped around the brush (12), wherein said protection assembly (32) is arranged within the nozzle housing (28) and comprises a plurality of spaced apart ribs (34) that extend at least partly through the brush (12), wherein a suction channel (42) is defined between a back end (44) of the ribs (34) and an opposite inner wall element (46) of the nozzle housing (28), wherein said back end (44) of the ribs (34) is facing away from the brush axis (14) and said inner wall element (46) is facing towards said back end (44) of the ribs (34) and spaced apart from said back end (44), and wherein the brush elements (16) extend at least partly into the suction channel (42) during the brush's rotation.

15 Claims, 5 Drawing Sheets

(56) References Cited

U.S. PATENT DOCUMENTS

| | | | | |
|---|---|---|---|---|
| 2,642,617 | A | 6/1953 | Lilly | |
| 3,646,629 | A * | 3/1972 | Bienek | A47L 11/33 15/48 |
| 3,863,285 | A * | 2/1975 | Hukuba | A47L 11/33 15/48 |
| 4,084,283 | A * | 4/1978 | Rosendall | A47L 11/33 15/48 |
| 4,095,304 | A * | 6/1978 | Shinozaki | A47L 11/33 15/48 |
| 4,802,254 | A | 2/1989 | Lahndorff | |
| 2005/0166353 | A1 | 8/2005 | Uehigashi | |
| 2009/0229075 | A1 * | 9/2009 | Eriksson | A46B 13/006 15/383 |

* cited by examiner

NOZZLE ARRANGEMENT FOR A CLEANING DEVICE

This application is the U.S. National Phase application under 35 U.S.C. §371 of International Application No. PCT/EP2013/076490, filed on Dec. 13, 2013, which claims the benefit of European Application No. 12197641.9 filed on Dec. 18, 2012. These applications are hereby incorporated by reference herein.

FIELD OF THE INVENTION

The present invention generally relates to the field of hard floor cleaning and vacuuming appliances. The present invention particularly relates to a nozzle arrangement for a floor cleaning device. Further, the present invention relates to a floor cleaning device that comprises such a nozzle arrangement.

BACKGROUND OF THE INVENTION

Hard floor cleaning these days is done by first vacuuming the floor, followed by mopping it. Vacuum removes the coarse dirt, while mopping removes the stains. From the state of the art many appliances, especially targeting the professional cleaning sector, are known that claim to vacuum and mop in one go. Appliances for the professional cleaning sector are usually specialized for big areas and perfectly flat floors. They rely on rotating brushes and suction power to get water and dirt from the floor. Appliances for home use often use a combination of a brush and a squeegee nozzle. Like the appliances for the professional cleaning sector these products use the brush to remove stains from the floor and the squeegee in combination with an under-pressure to lift the dirt from the floor.

A problem that has been identified is the fact that any obstacles on the surface to be cleaned may get caught by the rotating brush and wrapped around the brush. Depending on the size of the obstacle this could lead to jamming of the device. Especially when high rotating speeds are applied, the brush or other components of the floor cleaner may then be damaged or even completely destroyed. A further security risk is that a power cord may get caught and pulled into the nozzle of the floor cleaner. When the power cord has entered the system and there is a tension on the cord it can be wrapped around the brush. If the power cord touches the core of the brush, the cable could get damaged in such a way that the copper core of the cord will become in sight. This may result in a hazardous situation.

Some prior art devices solve this problem by a safety circuit that shuts off the cleaning device as soon as a power cable or any other large objects are entangled within the nozzle housing. These security switches usually either measure the voltage or identify if the mechanical resistance of the brush is suddenly increased due to a blockage. The disadvantage of these kind of systems is however that the power cord or any other large obstacle has already entered the nozzle when the device is turned off. Damages of the brush and the other parts of the device may therefore not be prevented. Apart from that the power cord or the obstacle needs to be detangled again. This may be inconvenient and time-consuming for the user.

Another solution that tries to solve the above-mentioned problem is shown in U.S. Pat. No. 4,802,254 A. U.S. Pat. No. 4,802,254 A discloses a floor cleaner that includes a rotatable brush having an elongate dowel with an anti-cord swallowing system formed by a plurality of grooves within the periphery of the dowel. The grooves are equally spaced along the length of the dowel. The anti-cord swallowing system also includes a plurality of equally spaced ribs that extend from an under surface of a power head housing of the cleaner. Each rib being aligned with and extending partially into one of the grooves. The clearance between each rib and its respective groove is such that free rotation of the brush is permitted while the possibility of even small diameter power cords being wrapped around the brush is minimized.

The solution shown in U.S. Pat. No. 4,802,254 A however still shows several disadvantages. On the one hand the applied ribs generate a relatively high friction as they completely extend through the hairs of the brush and contact the core of the brush. The anti-cord swallowing system therefore decreases the performance of the cleaning device. On the other hand there is still a chance that a power cord may get sucked into the nozzle housing as the anti-cord protection grid provided in U.S. Pat. No. 4,802,254 A mainly prevents a power cord from getting wrapped around the brush but not from entering the rest of the nozzle housing through the opening provided at the bottom side of the nozzle housing. Another major disadvantage of this solution is that dirt particles and long hairs will also be entangled within the anti-cord swallowing system. Especially hairs will therefore not efficiently be picked up or have to be removed from the ribs by hand, which again complicates the handling of the device.

A carpet sweeper with two sets of pivotally mount spaced cleaning fingers behind the brush is known from U.S. Pat. No. 2,642,617 A.

U.S. Pat. No. 1,483,976 A discloses a suction sweeper with brush guard fingers extending across the open mouth of the nozzle to make it impossible for any rug or floor covering to be drawn up too far into the open mouth.

EP 0 042 370 A1 discloses another cleaning device with at least one brush and a brush cover having webs which are arranged transversely to the axial direction of the brush and which engage between the bristle bundles of the brush on the half of the brush located on the cleaning side in the region of the open underside of the cover in order to prevent the drawing-in of loose articles by the brush.

SUMMARY OF THE INVENTION

It is an object of the present invention to provide a nozzle arrangement for a floor cleaning device that overcomes the above-mentioned problems. It is particularly an object to improve the protection of the nozzle arrangement in order to prevent large obstacles from getting sucked into the nozzle housing or wrapped around the rotating brush.

This object is achieved by a nozzle arrangement for a cleaning device, comprising:

- a nozzle housing;
- a brush rotatable about a brush axis, wherein the brush is partially surrounded by the nozzle housing and protrudes from a bottom side of said nozzle housing, said brush being provided with brush elements for picking up dirt and/or liquid particles from a surface to be cleaned during the rotation of the brush, and
- a protection assembly for preventing obstacles from getting sucked into the nozzle housing or wrapped around the brush, wherein said protection assembly is arranged within the nozzle housing on a lateral side of the brush where the brush elements enter the nozzle housing during the brush's rotation, and wherein said protection assembly comprises a plurality of spaced apart ribs that extend at least partly through the brush, wherein a suction channel is defined between a backside of the ribs and an opposite inner wall element of the nozzle housing, wherein said backside of the ribs is facing away from the brush axis and said inner wall element is facing towards said backside of the ribs, is spaced apart from said backside, and is during use of the nozzle arrangement arranged transverse to the surface to be cleaned, and wherein the brush elements extend at least partly into the suction channel during the brush's rotation.

The above-mentioned object is furthermore, according to a second aspect of the present invention, achieved by a floor cleaning device that comprises such a nozzle arrangement.

Preferred embodiments of the invention are defined in the dependent claims. It shall be understood that the claimed floor cleaning device has similar and/or identical preferred embodiments as the claimed nozzle arrangement and as defined in the dependent claims.

Similar as proposed in U.S. Pat. No. 4,802,254 A the protection assembly according to the present invention takes care that no obstacles, e.g. power cables, can be damaged such that a hazardous situation could appear. It prevents large objects, which are herein generally denoted as obstacles, to enter the nozzle in order to prevent breaking or blocking the system. In contrast to the solution proposed in U.S. Pat. No. 4,802,254 A the protection assembly according to the present invention also prevents dirt, especially long hairs, from getting stuck or entangled between or at the ribs of the protection assembly. The latter-mentioned feature is very important. If too many hairs get stuck or entangled between or at the ribs of the protection assembly, the cleaning result of the floor cleaning device would be drastically influenced in a negative way.

The reason why dirt particles, especially long hairs, are not entangled at or around the ribs is the provision of a suction channel that is defined in-between the back end of the ribs and the opposite inner wall element of the nozzle housing. The size of this suction channel is adapted such that large obstacles like power cords may not enter, while "conventional" dirt particles and hairs can be guided through this suction channel towards a dust pan. That means that all dirt particles, liquid particles and hairs always have a free path into the suction channel and will not get stuck on the safety ribs, but large obstacles or power cables cannot enter the nozzle housing. This is a significant improvement compared to the solution provided in U.S. Pat. No. 4,802,254 A.

Another central point of the present invention is that the brush elements extend at least partly into the suction channel during the brush's rotation. As the brush elements, i.e. the hairs/bristles of the brush, are preferably made of a flexible material, they do not necessarily need to extend into the suction channel when the cleaning device is shut off and the brush is not rotating. However, since the brush elements extend into the suction channel during the brush's rotation when they are straightened out, dirt and/or liquid particles will automatically be guided into the suction channel and will finally reach the dust pan.

According to an embodiment of the present invention said inner wall element of the nozzle housing is arranged parallel to the brush axis and, during use of the nozzle arrangement, substantially perpendicular to the surface to be cleaned.

The suction channel, according to this embodiment, therefore runs vertically upwards from the surface to be cleaned. It is to be noted that the suction channel denotes the whole space that appears between the plurality of the ribs of the protection assembly and the inner wall element of the nozzle housing. A cross-section of the suction channel (perpendicular to the brush axis) has a shape of a thin slot.

A further parameter that needs to be considered is the amount of friction that occurs between the ribs and the brush. The larger the ribs are and the larger the contact area between the ribs and the brush is, the higher will be the friction between the two. This contact area should thus be minimized. On the other hand, the ribs need to be large enough to prevent obstacles like power cords from getting sucked into the nozzle housing. Apart from that, the ribs may not be too small, as this would reduce the stiffness of each rib. Since the ribs are preferably made of a flexible material (e.g. plastic or rubber), the ribs need to be large and thick enough in order to prevent a buckling of the ribs. Therefore, a trade-off solution need to be found considering the size of the ribs.

According to an alternative embodiment of the present invention said inner wall element of the nozzle housing is arranged parallel to the brush axis and is, during use of the nozzle arrangement, inclined with respect to the surface to be cleaned. The back end of the ribs preferably extends parallel to the inner wall element.

Such an inclination of the suction channel relative to the surface to be cleaned has the following advantages: if the suction channel is inclined, i.e. not exactly perpendicular to the surface to be cleaned, the ribs may widen out towards their upper end. If the upper end of the ribs has a larger thickness, the stiffness of the ribs is significantly increased. The lower part of the ribs that extends through the brush may, however, still be relatively small in order to lower the friction between the ribs and the brush.

A slightly inclined suction channel furthermore has the advantage that less energy is needed in order to guide the dirt and/or liquid particles through the suction channel, since the suction channel does not run vertically upwards. Also in this embodiment it is important to note that the ribs are not directly attached to or in contact with the inner wall element of the nozzle housing. In all embodiments the back end of the ribs is spaced apart from the inner wall element of the nozzle housing.

According to an embodiment of the present invention a distance between the back end of the ribs and the inner wall element is in a range of 0.1 and 3 mm. This distance defines the width of the above-mentioned suction channel. If the width of the suction channel is within the above-mentioned range, the suction channel is large enough for "conventional" dirt particles and hairs to fit through but small enough that power cords or other unwanted obstacles may not enter the suction channel.

It is, however, not only important that power cords and the other unwanted obstacles will get kept out of the suction channel. Power cords shall also not hit against the core of the brush. Especially due to the high rotating speeds of the brush such a contact could easily damage the power cord and produce a short circuit.

According to a further embodiment of the present invention a distance between a lower end of at least one of the plurality of ribs and the surface to be cleaned is during use of the nozzle arrangement smaller than a distance between the brush axis and the surface to be cleaned.

The lower end of at least one of the ribs is thus arranged below the brush axis. Preferably, it is arranged below the brush core. A contact between an obstacle (power cord) and the brush core is therefore almost impossible. Since the lower end of the at least one rib is in this case arranged at a very low position, the inlet of the suction channel is also arranged very low with respect to the surface to be cleaned. This extremely facilitates the pick-up of dirt and liquid particles, as they do not need to travel long ways from the surface into the suction channel.

According to a further embodiment of the present invention the brush comprises a core element surrounding the brush axis, wherein at least one of the plurality of ribs comprises a protrusion at its lower end, wherein the protrusion protrudes from said at least one rib toward the core element.

Preferably all of the plurality of ribs comprise such a protrusion.

Due to this protrusion the lower end of the ribs is larger/thicker than the rest of the ribs. This has shown to be a very good solution for the above-mentioned trade-off that needs to be considered regarding a reduce friction and a large enough size of the ribs to keep obstacles out of the nozzle housing. If the largest/thickest part of the ribs is arranged at their lower end all obstacles will be blocked at this lower end. If the other parts of the ribs, that are arranged further above, are comparatively small, the overall friction between the brush and the ribs may still be reduced.

According to a further embodiment of the present invention, a distance between at least one of the plurality of ribs and said core element of the brush is smaller than 5 mm, preferably smaller than 3 mm.

This distance range has been found by experiments of the applicant. A too small distance between the core element and the ribs would again significantly increase the friction between the ribs and the brush. A too large distance would on the other hand bare the risk that obstacles like power cords enter into the space between the ribs and the brush.

The protection assembly is preferably arranged on a first side of the nozzle housing where the brush elements enter the nozzle housing during the brush's rotation. Dirt and/or liquid particles are therefore directly guided into the above-mentioned suction channel as soon as they are picked up from the floor and then released from the brush within the nozzle housing.

According to an embodiment of the present invention, the brush elements are adapted to contact the inner wall element.

The inner wall slightly bends the tip portions of the brush elements. If the brush elements are indented/bent at the inner wall element, the brush will act as a kind of whip at this interface. Since the brush elements are preferably realized by flexible, thin bristles, the bristles will be bent as soon as they come into contact with the inner wall element. If they lose the contact again during the brush's rotation the tip portions of the brush elements will straighten out again. This increases the acceleration at the tip portion of the brush elements such that dirt and/or liquid particles adhered to the bristles will be smashed away. Since the inner wall element preferably runs vertically upwards, the dirt and/or liquid particles will automatically be guided upwards along the suction channel in order to finally reach the dust pan.

According to a further embodiment of the present invention a longitudinal direction of the protection assembly is arranged parallel to the brush axis, wherein the plurality of ribs extend transverse to said longitudinal direction and are spaced apart from each other, wherein a distance between two of said ribs measured in said longitudinal direction is smaller than 2 cm.

If the distance between the ribs is chosen to be rather small (i.e. 2 cm or smaller) even very flexible cables may not enter into the suction channel. A distance of 2 cm or lower suffices that even a bent flexible cable may not get stuck in the interspace between two ribs.

According to a further embodiment of the present invention the nozzle arrangement further comprises a plurality of guiding elements for guiding dirt and/or liquid particles around the ribs, wherein the guiding elements are aligned with the ribs and arranged on the bottom side of the nozzle housing opposite said first side with respect to the brush.

In other words, these guiding elements are arranged on the other side of the brush than the protection assembly. The guiding elements may be realized by small studs that are arranged on the bottom side of the nozzle housing. These guiding elements are preferably adapted not to contact the floor. A contact of the guiding elements with the floor could otherwise increase the scratch load on the floor. The distance between the lower end of these guiding elements and the surface to be cleaned is preferably set to be in a range between 1 and 2 mm.

The major function of the guiding elements is to guide the dirt and/or liquid particles around the ribs. The guiding elements are thereto aligned with the ribs. The risk that e.g. hairs are entangled at the ribs is therefore decreased. The guiding elements additionally have a safety function. Power cords or other large obstacles will be stopped by the guiding elements and may therefore not even get caught by the brush, since the guiding elements are arranged in front of the brush. This also has a psychological feature. A user knows that power cords may not even get caught by the brush and may therefore not even have to fear any risk.

The cross-section of at least one of said plurality of guiding elements is preferably triangular. This triangular cross-section enables to split up the dirt particles on the floor and guide them around the safety ribs.

According to a further embodiment of the present invention the protection assembly is releasably connected to the nozzle housing and a lid is provided within the nozzle housing that allows to remove the protection assembly. This significantly facilitates the handling of the device. If the protection assembly (e.g. the safety ribs) are polluted, a user may easily remove the protection assembly in order to clean it. If the protection assembly is damaged, it may also be replaced by a new one. The protection assembly may, for example, be clamped into the nozzle housing. However, also other ways of fixing the protection assembly within the nozzle housing (e.g. with a screw coupling) are generally conceivable without leaving the scope of the present invention.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
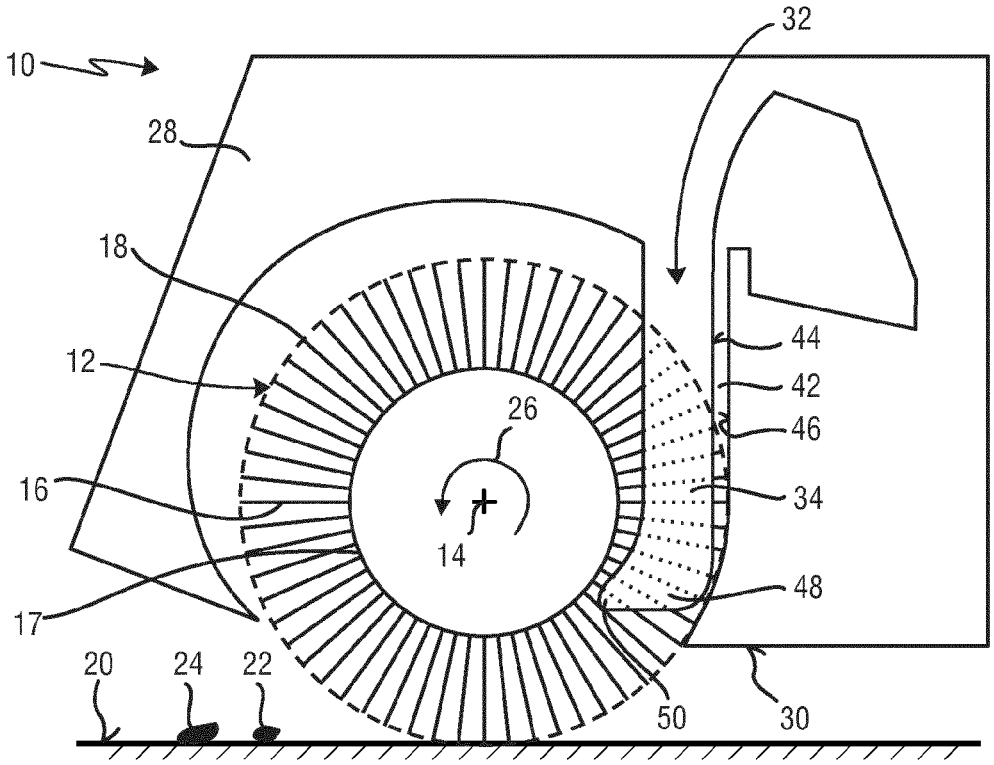
FIG. 1 shows a schematic cross-section of a first embodiment of a nozzle arrangement of a floor cleaning device according to the present invention.

FIG. 1 shows a schematic cross-section of a first embodiment of a nozzle arrangement 10 of a cleaning device 100 according to the present invention. The nozzle arrangement 10 comprises a brush 12 that is rotatable about a brush axis 14. Said brush 12 is provided with brush elements 16 that are arranged on a lateral area of a core element 17. The brush elements 16 extend radially outwards from said core element 17. The brush elements 16 are preferably realized as flexible, thin microfiber hairs. It shall be noted that the brush elements 16 are not always as straight as this is schematically illustrated in the figures. If the brush 12 is not rotating they may also hang loose. Only during the rotation of the brush they will get straightened out due to the occurring centrifugal forces.

The brush elements 16 comprise tip portions 18 which are adapted to contact a surface to be cleaned 20 during the rotation of the brush 12 and to pick up dirt particles 22 and/or liquid particles 24 from said surface 20.

Further, the nozzle arrangement 10 comprises a drive means, e.g. a motor (not shown), for driving the brush 12 in a predetermined direction of rotation 26. Said drive means are preferably adapted to realize a centrifugal acceleration at the tip portions 18 of the brush elements 16 which is, in particular during a dirt release period when the brush elements 16 are free from contact to the surface 20 during the rotation of the brush 12, at least 3,000 $m/s^2$.

The brush 12 is at least partly surrounded by a nozzle housing 28. The arrangement of the brush 12 within the nozzle housing 28 is preferably chosen such that the brush 12 at least partially protrudes from a bottom side 30 of the nozzle housing 28. During use of the device 100 the bottom side 30 of the nozzle housing 28 faces towards the surface to be cleaned 20.

Figure 7:
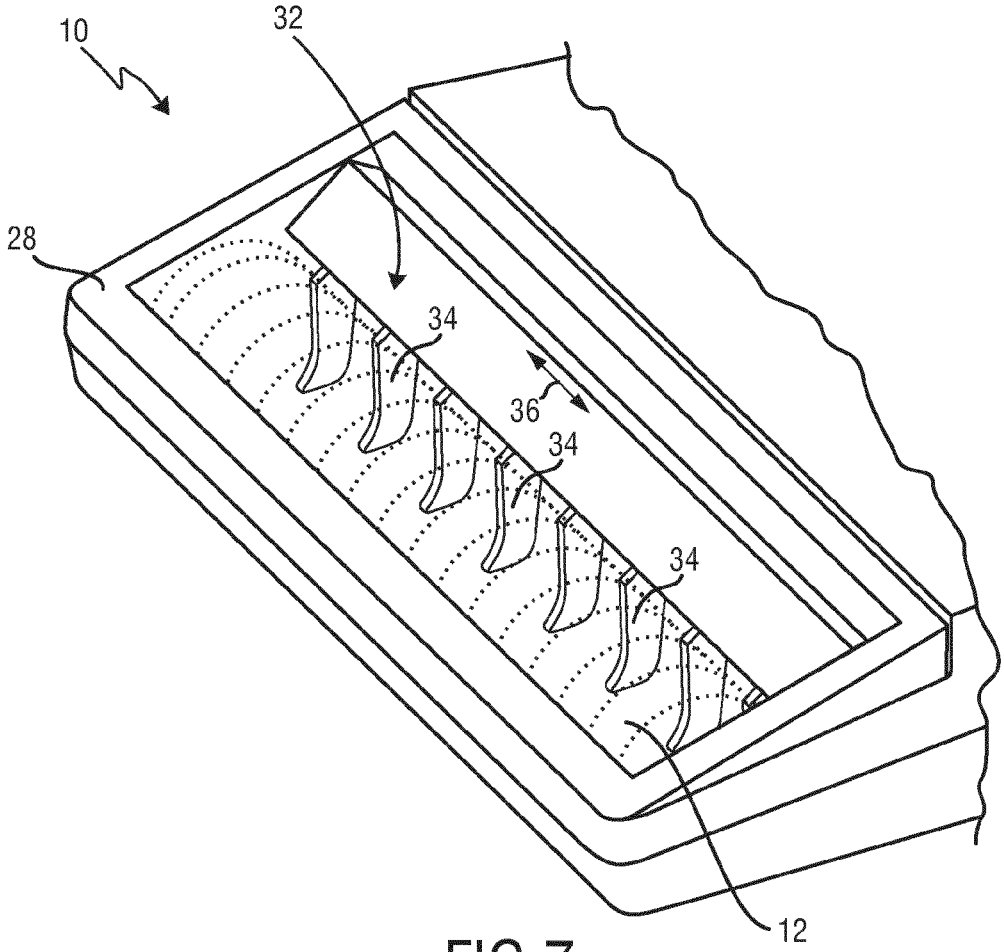
FIG. 7 shows a perspective view of the nozzle arrangement according to the present invention.

The nozzle arrangement 10 furthermore features a protection assembly 32 (see e.g. FIG. 7). This protection assembly 32 is one of the central features of the present invention. The protection assembly 32 is used for preventing obstacles from getting sucked into the nozzle housing 28 or wrapped around the brush 12. It acts as a kind of comb or barrier in order to prevent e.g. power cords from entering into the nozzle housing 28.

The protection assembly 32 comprises a plurality of ribs 34 that extend at least partly through the brush 12. The plurality of ribs 34 extend into the brush 12 similar as a comb. The brush elements 16 will therefore be slightly deflected at the ribs 34 or move around them.

The protection assembly 32 is arranged within the nozzle housing 28 in an area where the brush elements 16 enter the nozzle housing 28 during the brush's rotation. The longitudinal direction 36 of the protection assembly 32 (see FIG. 7) is preferably arranged parallel to the brush axis 14. The ribs 34 extend transverse to said longitudinal direction and are spaced apart from each other. A distance between two of said ribs 34 is preferably chosen to be smaller than 2 cm. Even very flexible power cords are therefore prevented from getting sucked into the interspace between two ribs 34.

Figure 6:
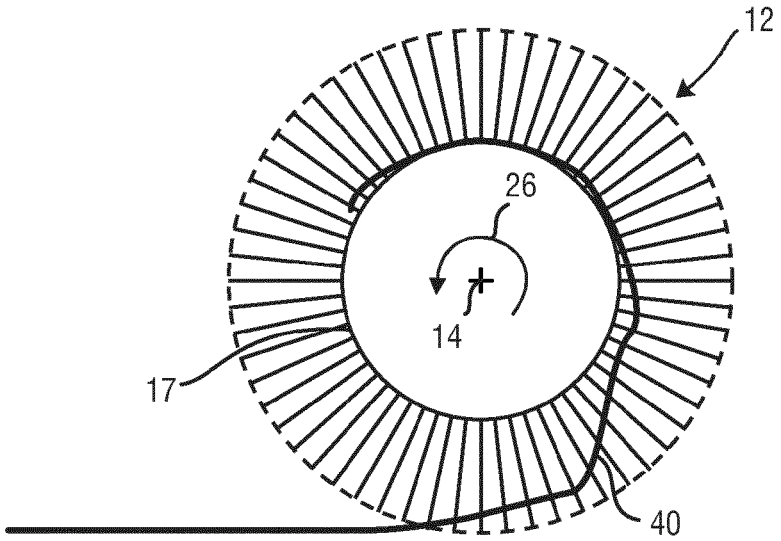
FIG. 6 schematically shows a hazardous situation that could occur when a power cord is wrapped around the brush.

Without the protection assembly 32 hazardous situations could occur. As schematically shown in FIG. 6 a power cord 40 could get pulled into the fast rotating brush 12 when run over. This could not only lead to a damage of the brush 12 or the nozzle housing 28 but could also damage the power cable 40. Especially if the power cable 40 is smashed against the hard core element 17 of the brush, the copper core of the power cable 40 may come in sight.

The interesting task is however to prevent unwanted large obstacles like power cables 40 from entering the system, while at the same time allowing dirt and/or liquid particles 22, 24 to be ingested. Protection assemblies according to the prior art often have the disadvantage that larger dirt particles 22 like hairs will also be in entangled at or around the ribs 34. The protection assemblies therefore have to be cleaned quite frequently. Apart from that this reduces the cleanability and the efficiency of the cleaning device.

The inventors of the present invention have found a solution that allows both, preventing large obstacles from entering the system and at the same time allowing dirt and/or liquid particles 22, 24 to efficiently get sucked in. One of the differences to prior art devices is the provision of a suction channel 42 that is arranged behind the ribs 34. This suction channel 42 is defined between a back end or back side 44 and an opposite inner wall element 46 of the nozzle housing 28. The back end 44 of the ribs 34 is facing away from the brush axis 14. The inner wall element 46 instead faces towards the brush axis 14 and also towards said back end 44 of the ribs 34. The back end 44 of the ribs 34 and the inner wall element 46 of the nozzle housing 28 are preferably arranged parallel to each other, such that a thin suction channel 42 is defined thereinbetween which has a shape of a thin slot.

Important to note is that the brush elements 16 of the brush 12 extend at least partly into the suction channel 42 during the brush's rotation. Picked up dirt and/or liquid particles 22, 24 are therefore directly guided into the suction channel 42. This suction channel 42 is preferably large enough that coarse dirt like hairs may enter, while power cables 40 or other unwanted obstacles may not. Since the safety ribs 34 extend into the brush 12, they will be automatically cleaned by the brush elements 16. As the brush 12 extends into the suction channel 42, even the rear side 44 of the ribs 34 will be cleaned. The risk that coarse dirt particles 22 like hairs will be entangled at, around or inbetween the ribs 34 is therefore significantly minimized.

The brush elements 16 are preferably adapted to contact the inner wall element 46 during the brush's rotation. In case of flexible brush elements 16 these brush elements 16 will get slightly deflected/bent as soon as they come into contact with the inner wall element 46. Due to this slight indentation the tip portions 18 of the brush elements 16 will get accelerated as soon as they lose contact again. The brush elements 16 therefore act similar as a whip at this interface. Dirt and/liquid particles 22, 24 adhered to the brush elements 16 will thus get launched and fly through the suction channel 42 toward a dust pan, where they are collected. A vacuum aggregate 38 (see FIG. 9) may be used in addition to improve the cleaning result. However, it shall be noted that the vacuum aggregate 38 is not absolutely mandatory.

As it can be seen in FIG. 1, the suction channel 42 is preferably arranged parallel to the brush axis 14 and runs vertically upwards relative to the surface to be cleaned 20. A distance between the back end 44 of the ribs 34 and the inner wall element 46 of the housing 28 is preferably within a range of 0.1 and 3 mm. This distance is small enough that power cables 40 cannot enter. A lower end 48 of the ribs 34 is arranged below the brush axis 14, preferably also below the core element 17 of the brush 12. Obstacles like power cables 40 that are caught by the brush 12 may thus not hit against the core element 17. Since the distance between the lower end 48 of the ribs 34 and the bottom side 30 of the nozzle housing 28 is smaller than the distance between the core element 17 and the bottom side 30 of the nozzle housing 28, these obstacles may not even get into contact with the core element 17. This is, as already mentioned above, an important security feature.

The safety ribs 34 may furthermore comprise a protrusion 50 at their lower ends 48. These protrusions 50 protrude from the ribs 34 toward the core element 17 of the brush 12. The protrusions reduce the distance between the core element 17 and the safety ribs 34. Unwanted obstacles may thus also not enter the nozzle housing 28 through the interspace between the safety ribs 34 and the core element 17 of the brush 12. The distance between the front end of said protrusions 50 and the core element 17 is preferably smaller than 5 mm, more preferably smaller than 3 mm.

Instead of having protrusions 50 at the lower ends 48 of the safety ribs 34, the safety ribs 34 could of course also be designed larger and have straight side walls (without protrusions 50). Larger safety ribs 34 would however increase the friction that occurs between these safety ribs 34 and the brush elements 16. This again would increase the wear and tear of the brush elements 16. Apart from that, stronger motors would be needed to achieve the desired rotational speeds of the brush 12. The protrusions 50 allow to have relatively thin upper parts of the ribs 34 and at the same time have a large blocking area at their lower ends 48.

Figure 2:
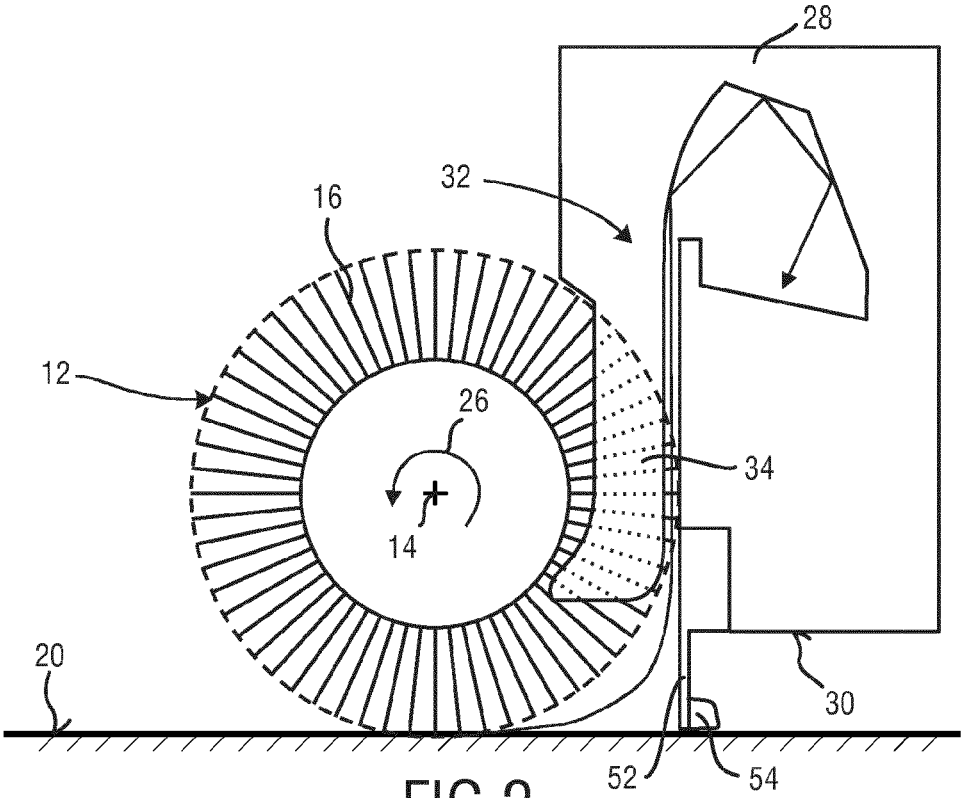
FIG. 2 shows a schematic cross-section of a second embodiment of the nozzle arrangement according to the present invention.

As schematically illustrated in FIG. 2, the nozzle arrangement 10 may furthermore feature a squeegee element 52. This squeegee element 52 is attached to the bottom side 30 of the nozzle housing 28. It is arranged such that it contacts the surface to be cleaned 20 during the use of the device 100. The squeegee 52 is used as a kind of wiper for pushing or wiping dirt particles 22 and/or liquid particles 24 across or of the floor 20 when the nozzle 10 is moved.

Said squeegee 52 extends substantially parallel to the brush axis 14. The squeegee 52 prevents dirt and/or liquid particles 24 from getting launched out of the nozzle housing 28 again. During the rotation of the brush 12 dirt and/or liquid particles 22, 24 will be encountered on the surface 20 and either guided to the suction channel 42 or smashed against the squeegee 52. If the particles 22, 24 are launched against the squeegee 52 they will get reflected therefrom. These reflected particles 22, 24 will reach again the brush 12 and get launched again. In this way the particles 22, 24 bounce for forth and back between the brush 12 and the squeegee 52 in a more or less zig-zag-wise manner, after they finally reach the suction channel 42 and then get ingested by the vacuum aggregate 38.

Some of the dirt and/or liquid particles 22, 24 will get launched from the surface 20 in such a flat manner that they will be re-sprayed back onto the surface 20 in the area between the brush 12 and the squeegee 52. This is also known as re-spraying effect. Since the squeegee 52 acts as a kind of wiper, these particles 22, 24 will not get launched out of the nozzle housing 28 again. Due to the underpressure that is applied by the vacuum aggregate 38 these re-sprayed particles 22, 24 can then also be ingested.

The squeegee 52 furthermore comprises a plurality of studs 54 that are arranged at the lower end of the squeegee 52. These studs 54 allow the flexible rubber lip of the squeegee 52 to flex about its longitudinal direction depending on the movement direction of the nozzle 10. If the nozzle 10 is moved in a backward direction the studs 54 will at least partly lift the squeegee 52 from the surface 20. This lifting action mainly occurs due to natural friction between the surface 20 and the studs 54. The studs 54 then act as a kind of stopper that decelerate the rubber lip 52 and forces it to flip over the studs 54. Small openings will then occur between the studs such that dirt and/or liquid particles 22, 24 may also enter the nozzle 10 when moved in the backward direction.

Figure 3:
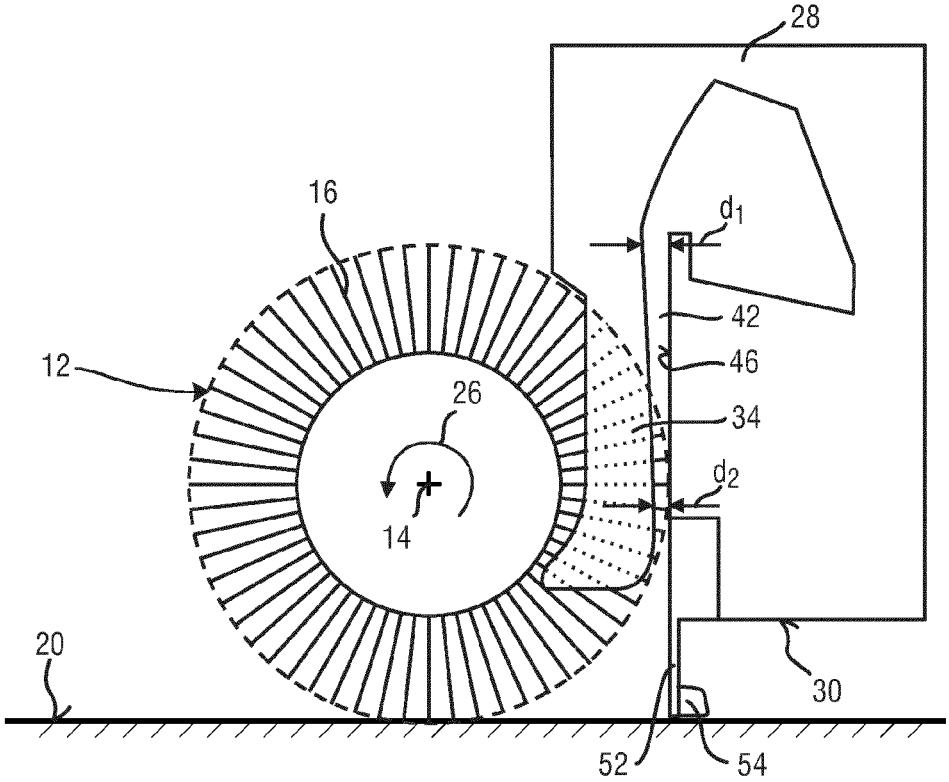
FIG. 3 shows a schematic cross-section of a third embodiment of the nozzle arrangement according to the present invention.

A further embodiment of the nozzle arrangement 10 is schematically shown in FIG. 3. As it can be seen in FIG. 3 the space between the ribs 34 and the inner wall element 46 (the suction channel 42) is slightly tapered. The suction channel 42 expands/widens, such that its cross-section becomes larger from bottom to top. The distance $d_1$ between the upper part of the rib 34 and the inner wall element 46 is therefore large than the distance $d_2$ between the lower part of the rib 34 and the inner wall element 46. The main advantage of such a tapered suction channel 42 is that the chance of dirt getting stuck within said channel 42 is minimized.

Figure 4:
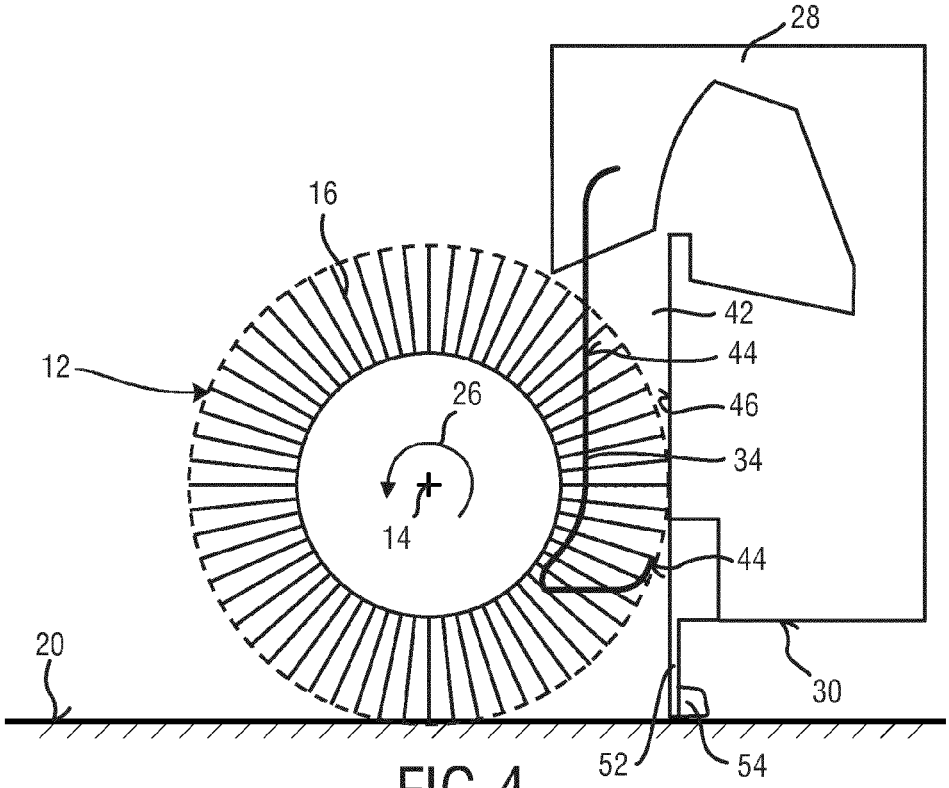
FIG. 4 shows a schematic cross-section of a fourth embodiment of the nozzle arrangement according to the present invention.

FIG. 4 shows a further embodiment of the nozzle arrangement 10 according to the present invention. Therein the at least one rib 34 of the protection assembly 32 is, instead of being built as a massive element, realized by a stiff, bent wire. The principle of the invention however remains the same. The suction channel 42 is defined between the back end 44 and the inner wall element 46, wherein the brush elements 16 extend into said suction channel 42. It shall be noted that the beck end 44 in this case denotes backside of the wire 34 that faces towards the inner wall element 46.

Figure 5:
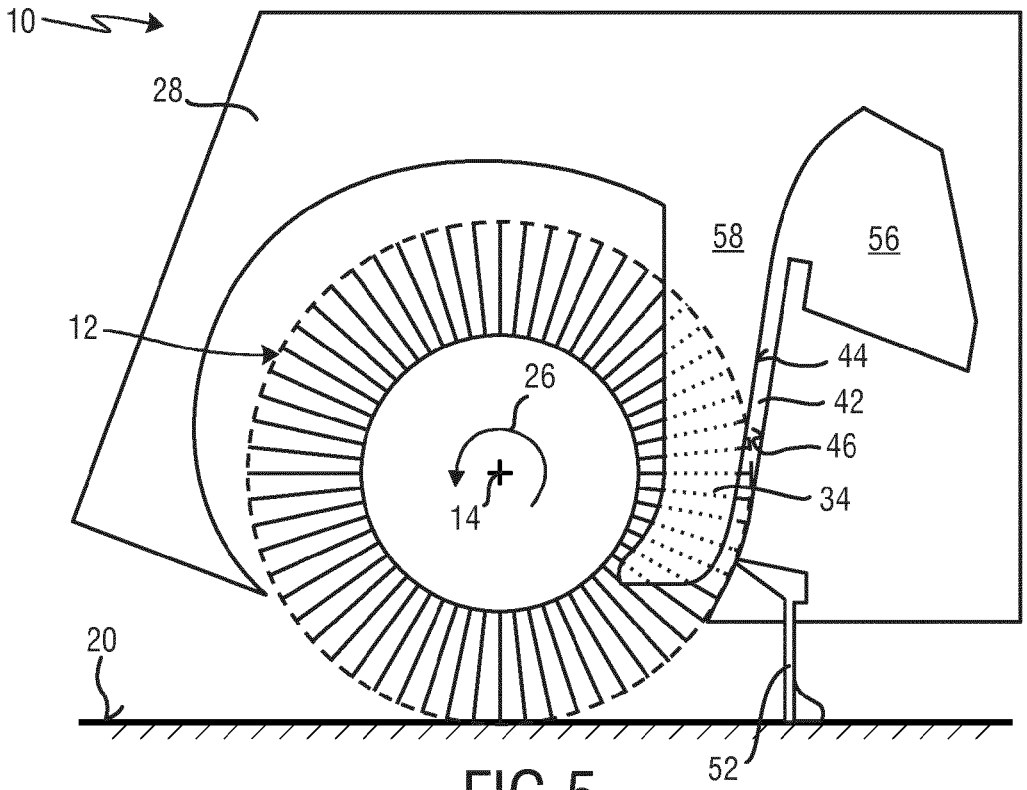
FIG. 5 shows a schematic cross-section of a fifth embodiment of the nozzle arrangement according to the present invention.

A still further embodiment is shown in FIG. 5. The embodiment shown in FIG. 5 mainly differs in the design of the security ribs 34 and the suction channel 42. In contrast to the first two embodiments shown in FIGS. 1 and 2 the suction channel 42 is slightly inclined with respect to the surface to be cleaned 20. The suction channel 42 is still substantially parallel to the brush axis 14, but in contrast to the first embodiments not arranged perpendicular to the surface to be cleaned 20. Such an inclined suction channel 42 has several advantages. Dirt particles 22 do not have to be lifted vertically upwards to reach the exhaust funnel 56. More important is however that the upper part 58 of the safety ribs 34 may be designed to be thicker than the lower parts of the ribs 34 (i.e. have a larger cross-section). As this upper part 58 of the ribs 34 does usually not extend into the brush, the above-mentioned friction problem can be neglected. A thicker upper part increases the stiffness of the safety ribs 34 significantly. Since the ribs 34 are preferably made of a light weight material, e.g. plastic, rubber etc., stiffness is also important to be considered. An inclined suction channel 42 allows to enlarge the upper parts 58 of the ribs 34 without having to enlarge the whole nozzle arrangement 10.

FIG. 7 shows a perspective view of the nozzle 10 from above. In order to easily remove the protection assembly 32 the nozzle housing 28 may comprise a lid (not shown) that allows to open the top of the nozzle housing 28. The protection assembly 32 may be removed from the nozzle housing 28 in order to clean it or to replace it, if it is damaged. The protection assembly 32 may be fixed to the nozzle housing 28 by the usage of a simple clamping mechanism. Other fixtures (e.g. using a screw connection) are also conceivable.

Figure 8:
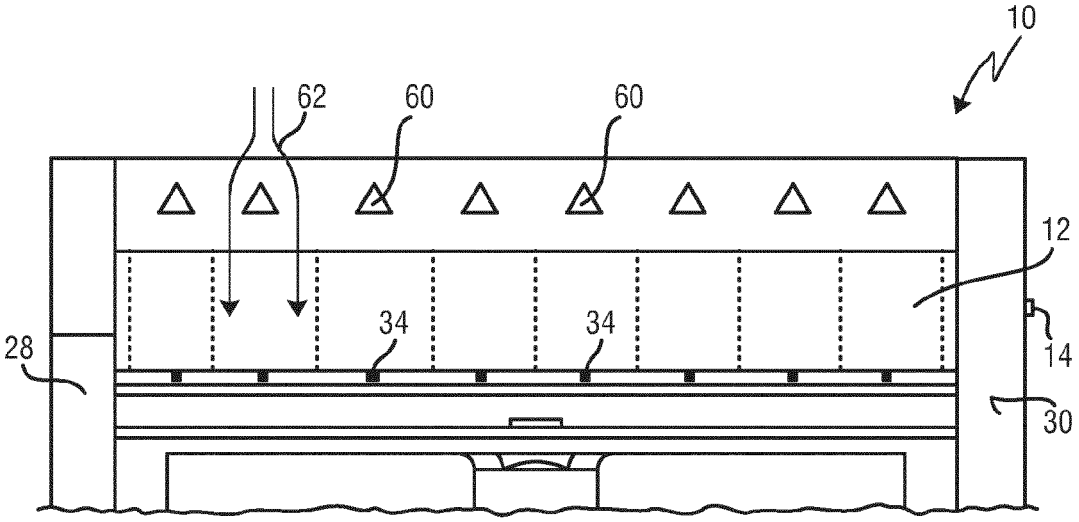
FIG. 8 shows a rear side of the nozzle arrangement according to a further embodiment.

FIG. 8 schematically illustrates the bottom side 30 of the nozzle housing 28. As illustrated therein, the nozzle arrangement 10 may further comprise a plurality of guiding elements 60 that are arranged on the bottom side 30 of the nozzle housing 28. These guiding elements 60 are used for guiding dirt and/or liquid particles 22, 24 around the ribs 34. The guiding elements 60 are aligned with the ribs 34 and preferably have a cross-section that is substantially triangular. This triangular cross-section allows to guide the dirt and/or liquid particles 22, 24 around the ribs 34 as indicated by arrows 62. This additional guidance reduces the risk that dirt and/or liquid particles 22, 24 will get entangled around the safety ribs 34.

The lower end of the guiding elements 60 is preferably arranged 1 or 2 mm above the floor 20 in order to prevent an additional friction between the nozzle 10 and the floor 20 or even scratching of the floor 20, which could occur when these guiding elements 60 are in direct contact with the floor 20. The guiding elements 60 are preferably realized as rubber studs.

In the following further properties of the brush 12 and the rotational speed with which the brush 12 is driven shall be presented. It shall be noted that the properties of the brush 12 mentioned below are preferred properties, which are no mandatory features. The protection assembly according to the present invention may be combined with any type of rotating brush.

A preferred brush 12 has a diameter in a range of 20 to 80 mm and the driving means may be capable of rotating the brush 12 at an angular velocity which is at least 3,000 revolutions per minute, preferably at an angular velocity around 6,000 rpm and above. A width of the brush 12, i.e. a dimension of the brush 12 in a direction in which the rotation axis 14 of the brush 12 is extending, may be in an order of 25 cm, for example.

On an exterior surface of the core element 17 of the brush 12, tufts 54 are provided. Each tuft 54 comprises hundreds of fiber elements, which are referred to as brush elements 16. For example, the brush elements 16 are made of polyester or nylon with a diameter in an order of about 10 micrometers, and with a Dtex value which is lower than 150 g per 10 km. A packing density of the brush elements 16 may be at least 30 tufts per $cm^2$ on the exterior surface of the core element 17 of the brush 12.

The brush elements 16 may be arranged rather chaotically, i.e. not at fixed mutual distances. Furthermore, it shall be noted that an exterior surface of the brush elements 16 may be uneven, which enhances the capability of the brush elements 16 to catch liquid droplets 24 and dirt particles 22. The brush elements 16 may be so-called microfibers, which do not have a smooth and more or less circular circumference, but which have a rugged and more or less star-shaped circumference with notches and grooves. The brush elements 16 do not need to be identical, but preferably the linear mass density of a majority of a total number of the brush elements 16 of the brush 12 meets the requirement of being lower than 150 g per 10 km, at least at tip portions 18.

Due to the chosen technical parameters the brush elements 16 have a gentle scrubbing effect on the surface 20, which contributes to counteracting adhesion of liquid 24 and dirt particles 22 to the surface 20.

As the brush 12 rotates, the movement of the brush elements 16 over the surface 20 continues until a moment occurs at which contact is eventually lost. When there is no longer a situation of contact, the brush elements 16 are urged to assume an original, outstretched condition under the influence of centrifugal forces which are acting on the brush elements 16 as a result of the rotation of the brush 12. As the brush elements 16 are bent at the time that there is an urge to assume the outstretched condition again, an additional, outstretching acceleration is present at the tip portions 18 of the brush elements 16, wherein the brush elements 16 swish from the bent condition to the outstretched condition, wherein the movement of the brush elements 16 is comparable to a whip which is swished. The acceleration at the tip portions 18 at the time the brush elements 16 have almost assumed the outstretched condition again meets a requirement of being at least 3,000 $m/sec^2$.

Under the influence of the forces acting at the tip portions 18 of the brush elements 16 the quantities of dirt particles 22 and liquid 24 are expelled from the brush elements 16, as these forces are considerably higher than the adhesion forces. Hence, the liquid 24 and the dirt particles 22 are forced to fly away in a direction which faces away from the surface 20. The most part of the liquid 24 and the dirt particles 22 is then ingested by the vacuum aggregate. By means of the squeegee element 52 and the under-pressure generated in the nozzle housing 28, it is ensured that also the remaining part of the liquid 24 and the dirt 22, that is sprayed back from the brush 12 to the surface 20, is collected and then also ingested.

Besides the functioning of each of the brush elements 16, as described in the foregoing, another effect which contributes to the process of picking up dirt particles 22 and liquid 24 may occur, namely a capillary effect between the brush elements 16. The brush 12 is comparable to a brush 12 which is dipped in a quantity of paint, wherein paint is absorbed by the brush 12 on the basis of capillary forces. In contrast to an agitator with stiff hairs, the brush 12 is therefore able to pick up liquid as well.

It appears from the foregoing that the brush 12 preferably has the following properties:

- the soft tufts 54 with the flexible brush elements 16 will be stretched out by centrifugal forces during the contact-free part of a revolution of the brush 12;
- it is possible to have a perfect fit between the brush 12 and the surface 20 to be cleaned, since the soft tufts 54 will bend whenever they touch the surface 20, and straighten out whenever possible under the influence of centrifugal forces;
- the brush 12 constantly cleans itself, due to sufficiently high acceleration forces, which ensures a constant cleaning result;
- heat generation between the surface 20 and the brush 12 is minimal, because of a very low bending stiffness of the tufts 54;
- a very even pick-up of liquid from the surface 20 and a very even overall cleaning result can be realized, even if creases or dents are present in the surface 20, on the basis of the fact that the liquid 24 is picked up by the tufts 54 and not by an airflow as in many conventional devices; and
- dirt 22 is removed from the surface 20 in a gentle yet effective way, by means of the tufts 54, wherein a most efficient use of energy can be realized on the basis of the low stiffness of the brush elements 16.

In comparison with conventional devices comprising hard brushes (agitators) for contacting a surface to be cleaned, the brush 12 which is preferably used according to the present invention is capable of realizing cleaning results which are significantly better. The micro-fiber hairs that are used as brush elements 16 also have the advantage that the hairs serve as a flow restriction. The brush 12 therefore shows a very good sealing effect. Stiff hairs of an adjutator could instead not do so.

Figure 9:
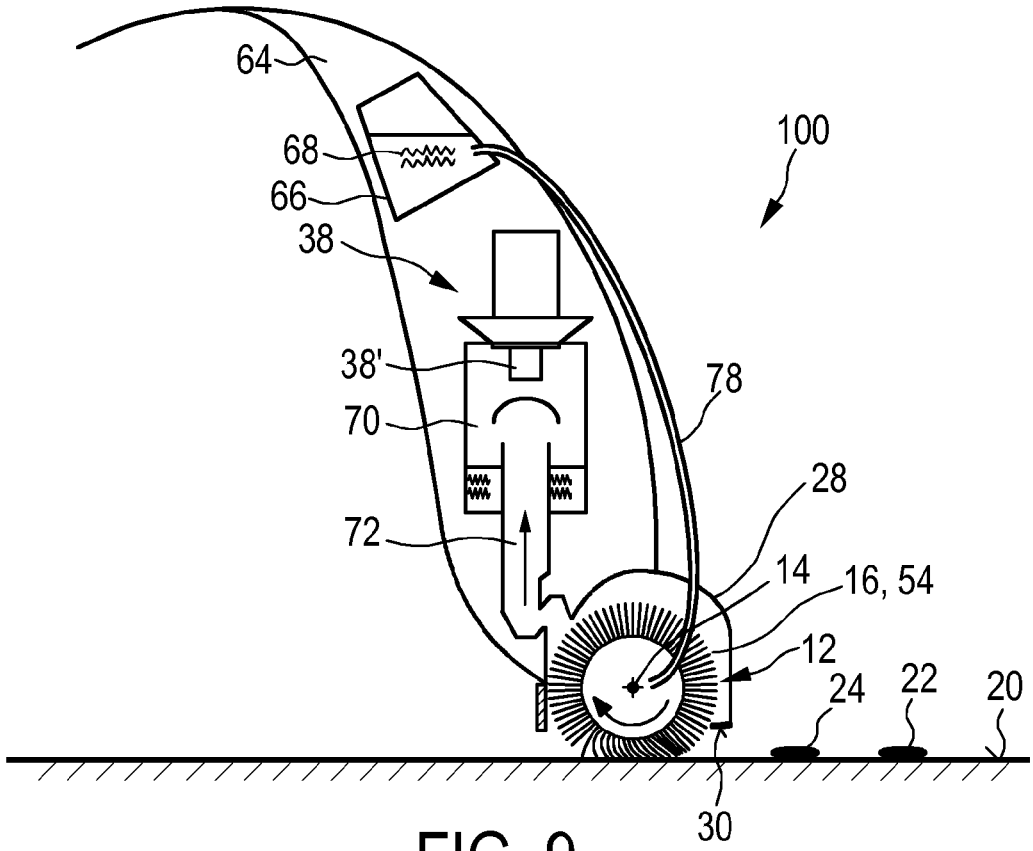
FIG. 9 shows a schematic cross-section of the cleaning device according to the present invention in its entirety.

FIG. 9 provides a view of the cleaning device 100 in its entirety. According to this schematic arrangement the cleaning device 100 comprises a nozzle housing 28 in which the brush 12 is rotatably mounted on the brush axis 14. A drive means, which can be realized being a regular motor, such as e.g. an electro motor (not shown), may be connected to the brush axis 14 for the purpose of driving the brush 12 in rotation. This motor may be located at any suitable position within the cleaning device 100.

The nozzle may further feature wheels (not shown) for keeping the rotation axis 14 of the brush 12 at a predetermined distance from the surface 20 to be cleaned.

Furthermore, the cleaning device 100 is preferably provided with the following components:

a handle 64 which allows for easy manipulation of the cleaning device 100 by a user;

a reservoir 66 for containing a cleansing liquid 68 such as water;

a debris collecting container 70 for receiving liquid 24 and dirt particles 22 picked up from the surface 20 to be cleaned;

a flow channel in the form of, for example, a hollow tube 72 that connects the debris collecting container 70 to the suction channel; and a vacuum fan aggregate 38 comprising a centrifugal fan 38', arranged at a side of the debris collecting chamber 70 which is opposite to the side where the tube 72 is arranged.

For sake of completeness, it is noted that within the scope of the present invention, other and/or additional constructional details are possible. For example, an element may be provided for deflecting the debris 22, 24 that is flung upwards, so that the debris 22, 24 first undergoes a deflection before it eventually reaches the debris collecting chamber 70.

Figure 10:
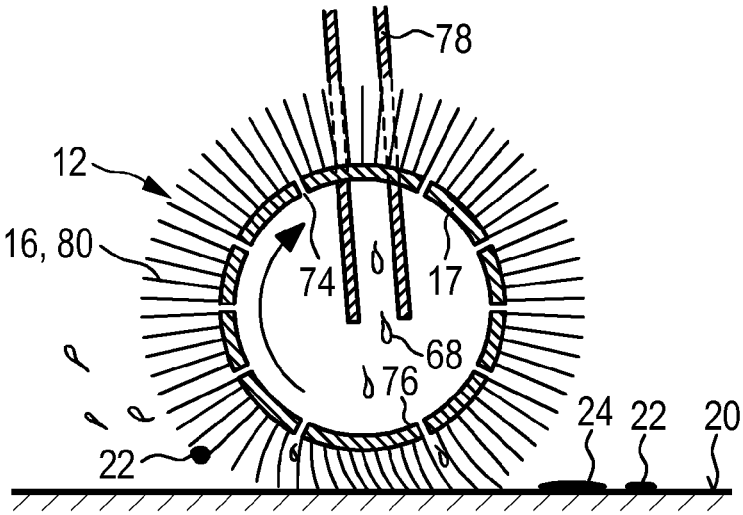
FIG. 10 shows a schematic cross-section of a further embodiment of a brush that may be used in the cleaning device according to the present invention.

According to an embodiment, which is shown in FIG. 10, the core element 17 of the brush 12 has a shape of a hollow tube that is provided with a number of channels 74 extending through a wall 76 of the core element 17. For the purpose of transporting cleansing fluid 68 from the reservoir 66 to the inside of the hollow core element 17 of the brush 12, e.g. a flexible tube 78 may be provided that leads into the inside of the core element 17.

Cleansing fluid 68 may be supplied to the hollow core element 17, wherein, during the rotation of the brush 12, the liquid 68 leaves the hollow core element 17 via the channels 74 and wets the brush elements 16. In this way the liquid 68 also drizzles or falls on the surface 20 to be cleaned. Therefore, the surface 20 to be cleaned becomes wet with the cleansing liquid 68. This especially enhances the adherence of the dirt particles 22 to the brush elements 16 and improves the ability to remove stains from the surface 20 to be cleaned.

The rate at which the liquid 68 is supplied to the hollow core element 17 can be quite low. A maximum rate can be 6 ml per minute per cm of the width of the brush 12, for example.

It is to be noted that the feature of actively supplying water 68 to the surface 20 to be cleaned using hollow channels 74 within the brush 12 is not a necessary feature. Alternatively a cleansing liquid could be supplied by spraying the brush 12 from outside or by simply immersing the brush 12 in cleansing water before the use. Instead of using an intentionally chosen liquid it is also possible to use a liquid that has been already spilled, i.e. a liquid that needs to be removed from the surface 20 to be cleaned.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. Nozzle arrangement for a floor cleaning device, comprising:

a nozzle housing;

a brush rotatable about a brush axis, wherein the brush is partially surrounded by the nozzle housing and protrudes from a bottom side of said nozzle housing, said brush being provided with brush elements for picking up dirt and/or liquid particles from a surface to be cleaned during the rotation of the brush, and a protection assembly for preventing obstacles from getting sucked into the nozzle housing or wrapped around the brush, wherein said protection assembly is arranged within the nozzle housing on a lateral side of the brush where the brush elements enter the nozzle housing during the brush's rotation, and wherein said protection assembly comprises a plurality of spaced apart ribs that extend at least partly through the brush, wherein a suction channel is defined between a backside of the ribs and an opposite inner wall element of the nozzle housing, wherein said backside of the ribs is facing away from the brush axis and said inner wall element is facing towards said backside of the ribs, is spaced apart from said backside and is during use of the nozzle arrangement arranged transverse to the surface to be cleaned, and wherein the brush elements extend at least partly into the suction channel during the brush's rotation.

2. Nozzle arrangement according to claim 1, wherein said inner wall element of the nozzle housing is arranged parallel to the brush axis and, during use of the nozzle arrangement Vii, substantially perpendicular to the surface to be cleaned.

3. Nozzle arrangement according to claim 1, wherein said inner wall element of the nozzle housing is arranged parallel to the brush axis and is, during use of the nozzle arrangement, inclined with respect to the surface to be cleaned.

4. Nozzle arrangement according to claim 1, wherein the backside of the ribs extends parallel to the inner wall element.

5. Nozzle arrangement according to claim 1, wherein a distance between the backside of the ribs and the inner wall element is in a range of 0.1 and 3 mm.

6. Nozzle arrangement according to claim 1, wherein, during use of the nozzle arrangement, a distance between a lower end of at least one of the plurality of ribs and the surface to be cleaned is smaller than a distance between the brush axis and the surface to be cleaned.

7. Nozzle arrangement according to claim 6, wherein the brush comprises a core element surrounding the brush axis, wherein at least one of the plurality of ribs comprises a protrusion at its lower end, wherein the protrusion protrudes from said at least one rib toward the core element.

8. Nozzle arrangement according to claim 1, wherein the brush comprises a core element surrounding the brush axis, wherein a distance between at least one of the plurality of ribs and said core element is smaller than 5 mm, preferably smaller than 3 mm.

9. Nozzle arrangement according to claim 1, wherein the protection assembly is arranged on a first side of the nozzle housing where the brush elements enter the nozzle housing during the brush's rotation.

10. Nozzle arrangement according to claim 9, wherein the nozzle arrangement further comprises a plurality of guiding elements for guiding dirt and/or liquid particles around the ribs, wherein the guiding elements are aligned with the ribs and arranged on the bottom side of the nozzle housing opposite said first side with respect to the brush.

11. Nozzle arrangement according to claim 10, wherein a cross-section of at least one of said plurality of guiding elements is substantially triangular.

12. Nozzle arrangement according to claim 1, wherein the brush elements are adapted to contact the inner wall element.

13. Nozzle arrangement according to claim 1, wherein a longitudinal direction of the protection assembly is arranged parallel to the brush axis, wherein the plurality of ribs extend transverse to said longitudinal direction and are spaced apart from each other, wherein a distance between two of said ribs measured in said longitudinal direction is smaller than 2 cm.

14. Nozzle arrangement according to claim 1, wherein the protection assembly is releasably connected to the nozzle housing and wherein a lid is provided within the nozzle housing that allows to remove the protection assembly.

15. A floor cleaning device comprising a nozzle arrangement according to claim 1.

* * * * *